US009701454B2

(12) United States Patent
Jeon

(10) Patent No.: US 9,701,454 B2
(45) Date of Patent: Jul. 11, 2017

(54) WRAPPER FOR RICE COVERED WITH LAVER

(76) Inventor: Myoung Ho Jeon, Suwon-si (KR)

( * ) Notice: Subject to any disclaimer, the term of this patent is extended or adjusted under 35 U.S.C. 154(b) by 0 days.

(21) Appl. No.: 13/812,520

(22) PCT Filed: Jul. 28, 2010

(86) PCT No.: PCT/KR2010/004971

§ 371 (c)(1),
(2), (4) Date: Mar. 28, 2013

(87) PCT Pub. No.: WO2012/015080

PCT Pub. Date: Feb. 2, 2012

(65) Prior Publication Data

US 2013/0189403 A1 Jul. 25, 2013

(51) Int. Cl.

| | |
|---|---|
| ***B65D 65/26*** | (2006.01) |
| ***B65D 75/00*** | (2006.01) |
| ***B65D 81/32*** | (2006.01) |
| ***B65D 65/22*** | (2006.01) |
| ***B65D 75/58*** | (2006.01) |
| ***B65D 75/66*** | (2006.01) |

(52) U.S. Cl.
CPC ..... *B65D 65/22* (2013.01); *B65D 75/5827* (2013.01); *B65D 75/5838* (2013.01); *B65D 75/5844* (2013.01); *B65D 75/66* (2013.01)

(58) Field of Classification Search
CPC ..... B65D 65/22; B65D 75/5827
USPC ..... 229/87.05, 87.08; 426/115
See application file for complete search history.

(56) References Cited

U.S. PATENT DOCUMENTS

| | | | | | |
|---|---|---|---|---|---|
| 4,230,728 | A * | 10/1980 | Tezuka | 426/115 |
| 4,251,552 | A * | 2/1981 | Uno et al. | 426/115 |
| 4,251,553 | A * | 2/1981 | Kobayashi | 426/115 |
| 4,623,568 | A * | 11/1986 | Suzuki | 428/40.1 |
| 5,356,068 | A * | 10/1994 | Moreno | 229/87.05 |
| 5,411,202 | A * | 5/1995 | Fenini | 229/87.05 |
| 6,464,821 | B1 * | 10/2002 | Phillips et al. | 156/304.1 |
| 6,544,569 | B1 * | 4/2003 | Suzuki et al. | 426/115 |
| 7,434,371 | B2 * | 10/2008 | Stivani et al. | 53/412 |

(Continued)

FOREIGN PATENT DOCUMENTS

| | | | | |
|---|---|---|---|---|
| JP | 05-072764 U | | 10/1993 | |
| JP | 2005-95111 | * | 4/2005 | A23L 1/10 |
| KR | 10-1997-0003302 B1 | | 3/1997 | |

(Continued)

OTHER PUBLICATIONS

International Search Report for PCT/KR2010/004971 mailed from ISA/KR on Apr. 29, 2011.

*Primary Examiner* — Jes F Pascua
*Assistant Examiner* — Derek Battisti
(74) *Attorney, Agent, or Firm* — Revolution IP, PLLC

(57) ABSTRACT

Disclosed is a wrapper for rice covered with layer, which is used to wrap a lump of rice. The wrapper comprising, two films forming sealing parts that are sealed to each other at outer peripheral parts thereof and including laver therebetween, a first cutting groove including a lateral groove formed toward a lateral direction of the film for cutting the film toward a longitudinal direction at a longitudinal upper part of one of the two films, and a covering part attached to seal the first cutting groove. In this case, the first cutting groove is formed under the sealing part longitudinally.

5 Claims, 10 Drawing Sheets

(56) References Cited

U.S. PATENT DOCUMENTS

| | | | | |
|---|---|---|---|---|
| 8,512,851 | B2 * | 8/2013 | Mass | 428/195.1 |
| 2011/0123687 | A1 * | 5/2011 | Gass | 426/132 |

FOREIGN PATENT DOCUMENTS

| | | | |
|---|---|---|---|
| KR | 10-0334939 | B1 | 5/2002 |
| KR | 10-0771250 | B1 | 10/2007 |

* cited by examiner (a)

(b)

(c)

WRAPPER FOR RICE COVERED WITH LAVER

CROSS REFERENCE TO PRIOR APPLICATIONS

This application is a National Stage Application of PCT International Patent Application No. PCT/KR2010/004971, filed on Jul. 28, 2010, under 35 U.S.C. §371, which is hereby incorporated by reference in its entirety.

BACKGROUND OF THE INVENTION

1. Field of the Invention

The present invention relates to a wrapper for rice covered with laver, and more particularly, to a wrapper for wrapping triangular rice covered with laver or lump-shaped rice covered with layer.

2. Description of the Related Art

In a conventional wrapper that is used to wrap a lump of rice covered with laver K, laver K is interposed between two layers 100 and 200, that is, outer and inner layers 100 and 200 that have a rectangular shape, and sealing parts 100A and 200A are formed by welding peripheral portions of the outer and inner layers 100 and 200, as shown in FIG. 14.

In order to easily separate the outer layer 100, a cutting band 110 is formed at the outer layer 100. The inner layer 200 is constituted by forming an overlapping part 210 in which two halves are overlapped.

The wrapper for rice covered with laver having the rectangular shape is folded along a triangular lump of rice R, so that a wrapper for triangular rice covered with laver is completed.

To eat the rice covered with laver that is wrapped as described above, first, a step (i) of cutting the outer layer 100 of the wrapper for rice covered with laver into both sides with respect to the longitudinal direction by pulling a cutting band, which is provided in the middle of the wrapper for triangular rice covered with laver in a longitudinal direction, from the top to the bottom in a vertical direction on the front side of the wrapper for triangular rice covered with layer.

After that, a step (ii) of separating the wrapper into left and right halves with respect to a vertical centerline is performed by pulling the cut wrapper for rice covered with laver toward both sides, so that only laver and rice remain. Then, a user wraps the triangular lump of rice with layer, and eats the rice covered with layer.

For easily cutting the outer layer 100 by pulling it vertically and downwardly with respect to the cutting band 110, an outer opening 120 without the sealing part 100A is formed at longitudinal upper portions and lower portions of the cutting band 110.

Similarly, an inner opening 220 without the sealing part 200A is formed at upper and lower portions of the overlapping part 210.

Furthermore, these outer and inner openings 120 and 220 are arranged to be opened toward the upper portions when a triangular lump of rice covered with layer.

Accordingly, external air is come in through the outer and inner openings 120 and 220 of the wrapper for rice covered with layer, so that expiration data of products is shortened. Due to vapor generated from rice, laver is made damp, and at the same time, air is transferred to rice through the wrapper so that the taste of rice becomes deteriorated.

As mentioned above, since both ends of the inner layer 200 is opened and each halves of the inner layer 200 is not sealed and simply overlapped at the overlapping part 210 that is extended in the longitudinal direction, the above-mentioned problems become more serious.

BRIEF SUMMARY OF THE INVENTION

Accordingly, the present invention is to address the above-mentioned problems and/or disadvantages and to offer at least the advantages described below.

It is, accordingly, an object of the present invention to provide a wrapper for rice covered with laver capable of extending a shelf date of products and preventing laver from being made damp, and at the same time, preventing the taste of the rice covered with laver from being deteriorate and easily cutting the wrapper by completely sealing layer.

Embodiments of the present invention provide a wrapper for rice covered with layer, which is used to wrap a lump of rice, the wrapper comprising, two films forming sealing parts that are sealed to each other at outer peripheral parts thereof and including laver therebetween, a first cutting groove including a lateral groove formed toward a lateral direction of the film for cutting the film toward a longitudinal direction at a longitudinal upper part of one of the two films, and a covering part attached to seal the first cutting groove. In this case, the first cutting groove is formed under the sealing part longitudinally.

In some embodiments of the present invention, the lateral groove is formed in horizontally or slantly with respect to a lateral direction.

In some embodiments of the present invention, a longitudinal groove being cut to be downwardly extended to a longitudinal direction is additionally formed at an end of the lateral groove of the first cutting groove. The covering part is attached to seal the longitudinal groove.

In some embodiments of the present invention, a second cutting groove being cut to be upwardly extended to a longitudinal direction is additionally formed at the lateral groove of the first cutting groove. The covering part is attached to seal the second cutting groove.

In some embodiments of the present invention, the other of the two films includes a folding part having a width to a lateral direction and extended to a longitudinal direction.

In some embodiments of the present invention, a concave with a smaller lateral width is formed at the folding part.

In some embodiments of the present invention, the concave is formed at a center of a longitudinal direction.

In some embodiments of the present invention, a concave in which a width of the folding part is smaller toward the center of the longitudinal direction at the folding part.

In some embodiments of the present invention, a cutting band extended to a longitudinal direction is additionally formed at peripheral portions of the first cutting groove.

Other aspects, advantages, and salient features of the invention will become apparent to those skilled in the art from the following detailed description, which, taken in conjunction with the annexed drawings, discloses exemplary embodiments of the invention.

Advantageous Effects

As above mentioned, according to an embodiment of the present invention, the expiration data of products cab be lengthened and deterioration of laver can be prevented by completely sealing laver disposed in a wrapper for rice covered with laver from outside air.

Also, a user can easily and conveniently separate the wrapper due to the simple removal of the wrapper together with complete sealing.

Furthermore, a method for separating a wrapper for rice covered with laver is performed in a conventional way. For this reason, if a user has triangular rice covered with laver wrapped with a new wrapper, a user can easily separate the wrapper due to the simple removal of the wrapper without any inconvenience, it is possible to improve product competitiveness of the wrapper for rice covered with layer.

DETAILED DESCRIPTION OF THE INVENTION

Exemplary, non-limiting embodiments of the present invention will now be described more fully with reference to the accompanying drawings. This invention may, however, be embodied in many different forms and should not be construed as limited to the exemplary embodiments set forth herein. Rather, the disclosed embodiments are provided so that this disclosure will be thorough and complete, and will fully convey the scope of the invention to those skilled in the art. The principles and features of this invention may be employed in varied and numerous embodiments without departing from the scope of the invention.

Furthermore, well known or widely used techniques, elements, structures, and processes may not be described or illustrated in detail to avoid obscuring the essence of the present invention. Although the drawings represent exemplary embodiments of the invention, the drawings are not necessarily to scale and certain features may be exaggerated or omitted in order to better illustrate and explain the present invention.

Figure 1:
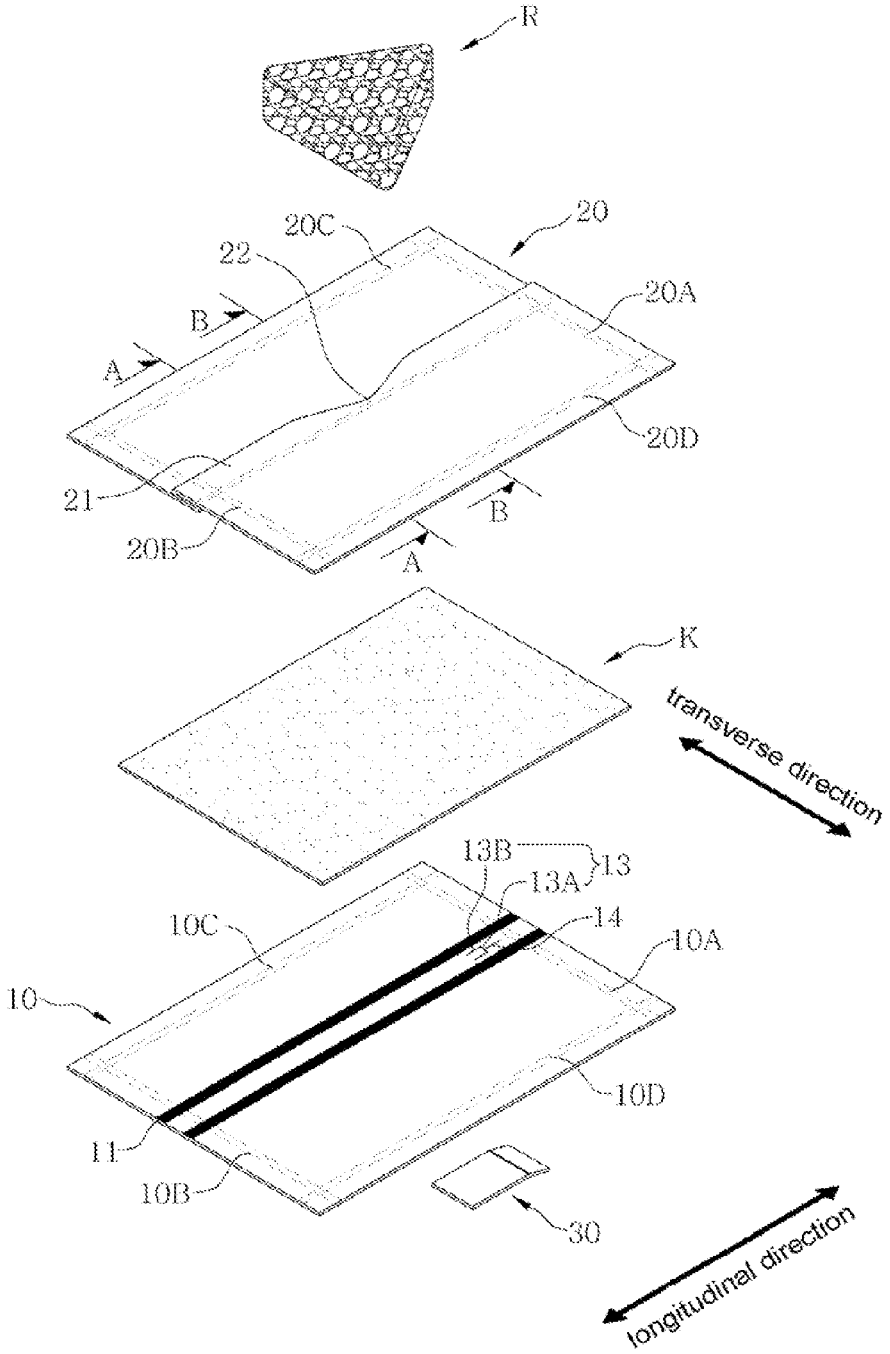
FIG. 1 is a development perspective view of a wrapper for rice covered with laver in accordance with an embodiment of the present invention.
Figure 2:
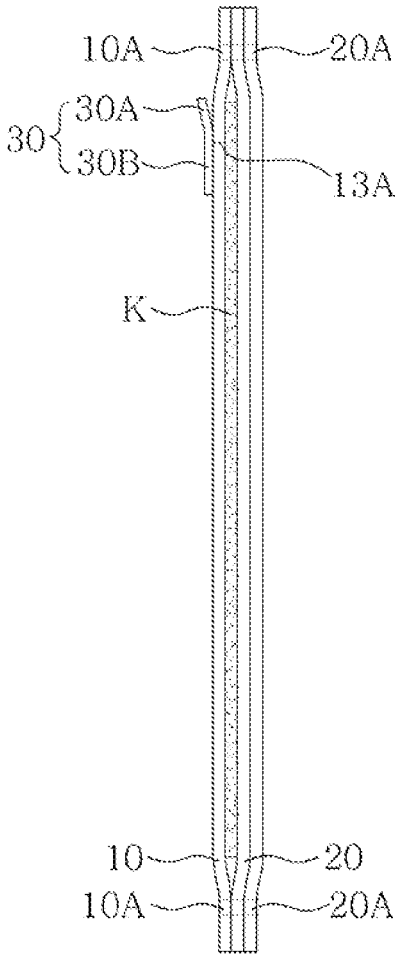
FIG. 2 is a sectional side elevation view of the wrapper for rice covered with laver in accordance with an embodiment of the present invention.

FIG. 1 is a development perspective view of a wrapper for rice covered with laver in accordance with an embodiment of the present invention. FIG. 2 is a sectional side elevation view of the wrapper for rice covered with laver in accordance with an embodiment of the present invention.

A wrapper for rice covered with laver includes an outer layer 10 forming an outer surface and an inner layer 20 attached to the outer layer for covering laver K disposed on the outer layer.

The shape of outer layer 10 is tetragonal. The outer layer 10 is formed of film such as polypropylene or plastic material. Also, the outer layer 10 may be formed of another material that is easily broken by a cutting band.

At a center of the outer layer 10, a cutting band 11 upwardly and downwardly extended in a longitudinal direction is formed. The cutting band 11 may formed in one entity with the outer layer or separately.

The cutting band 11 is publicly well known in the art. Also, the cutting band 11 is made of red color for easy discerning and formed of materials stronger than the outer layer 10.

In the present embodiment, the wrapper is formed with the cutting band 11, but not limited to the disclosed embodiments. If outer layer materials are easily broken, the cutting band 11 may not be formed on occasion demands.

Outer layer sealing parts 10A, 10B, 10C, and 10D and inner layer sealing parts 20A, 20B, 20C, and 20D, which are formed by welding the outer and inner layers 10 and 20 are formed on all peripheral portions of the outer and inner layers 10 and 20, respectively, thereby completely blocking inflowing of air from the outside.

Figure 3:
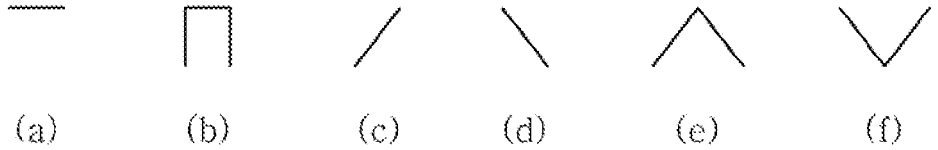
FIG. 3 shows various modified embodiments of a first cutting groove at an outer layer of the wrapper for rice covered with laver in accordance with an embodiment of the present invention.

FIG. 3 shows various modified embodiments of a first cutting groove at an outer layer of the wrapper for rice covered with laver in accordance with an embodiment of the present invention.

A first cutting groove 13 is formed under the outer layer sealing part 10A at the outer layer 10.

The first cutting groove 13 includes a horizontal part 13*a* and a vertical part 13*b*. The horizontal part 13*a* is extended to a lateral direction of the outer layer 10 and is formed in "-" shape. The vertical part 13*b* is downwardly extended to a longitudinal direction of the outer layer 10 at both ends of the horizontal part 13*a* and is formed in "|" shape.

In order to easily cut the outer layer 10 in a longitudinal direction, as mentioned above, the first cutting groove 13 may include both the horizontal part 13*a* and the vertical part 13*b* or include one of them.

The shape of the first cutting groove 13 may be various if a lateral component may exist at a cutting groove. For example, as shown in FIG. 3, the first cutting groove 13 may be formed in slant-groove shape.

In the meanwhile, a second cutting groove 14 is additionally formed upwardly extended in a longitudinal direction of the outer layer 10 at upper parts of the first cutting groove 13.

Figure 4:
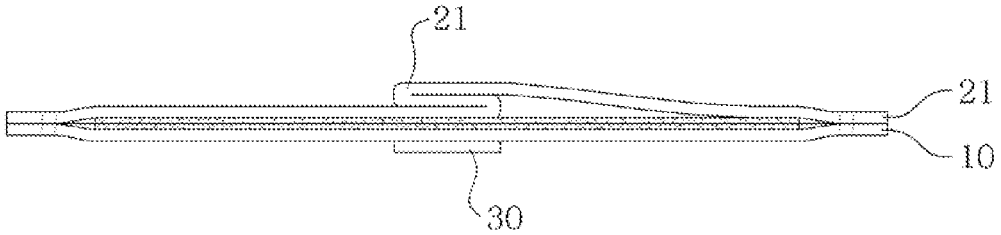
FIG. 4*a* is a cross-sectional view taken along line A-A of FIG. 1.
FIG. 4*b* is a cross-sectional view taken along line B-B of FIG. 1.
FIG. 4*c* shows another embodiment of a concave of an inner layer in the wrapper for rice covered with laver in accordance with the present invention.
Figure 4:
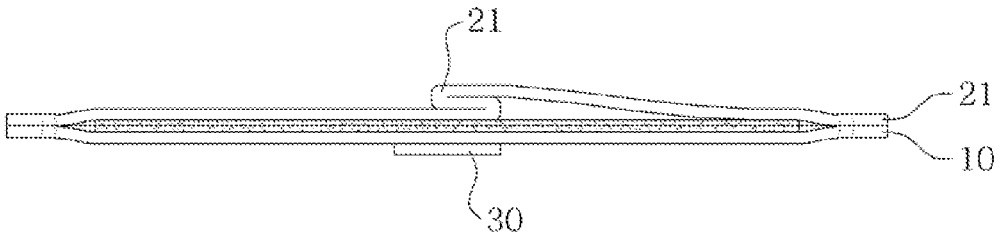
Figure 4:
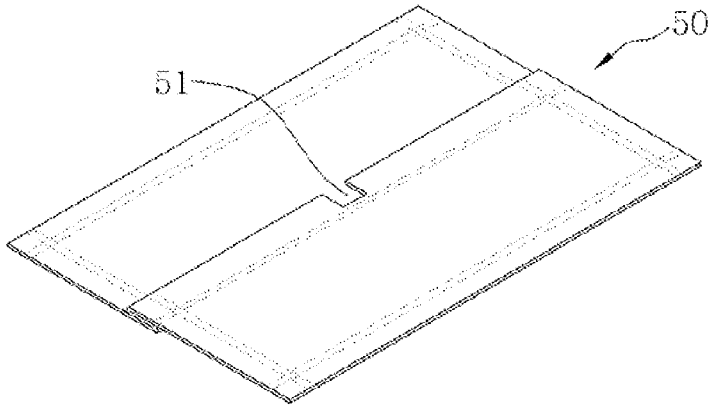

FIG. 4*a* is a cross-sectional view taken along line A-A of FIG. 1. FIG. 4*b* is a cross-sectional view taken along line B-B of FIG. 1. FIG. 4*c* shows another embodiment of a concave of an inner layer in the wrapper for rice covered with laver in accordance with the present invention.

The inner layer 20, as shown in FIG. 4*a*, includes a folding part 21, which is formed to have a width in a lateral direction and extended in a longitudinal direction. In general, the lateral width of the folding part 21 is formed uniformly.

At an approximate longitudinal center of the folding part 21, as shown in FIG. 4*b*, a concave 22 having a shape where the longitudinal width of the folding part is reduced is formed.

In another modified embodiment of the present invention, the concave 51 may be formed in a shape in which the width of the folding part does not be gradually reduced as shown in FIG. 4*c*.

The concaves 22 and 51 perform a function to generate stress concentration to easily break the inner layer 20 when the wrapper for rice covered with laver is pulled in both sides later on.

A covering part 30 comprises a holding part 30A and an attachment part 30B.

The holding part 30A is protruded from the outer layer 30 so that a user can easily hold.

The attachment part 30B is coated with an adhesive. Accordingly, the attachment part 30B is attached to cover the first cutting groove 13 or the first and second cutting grooves 13 and 14.

Figure 5:
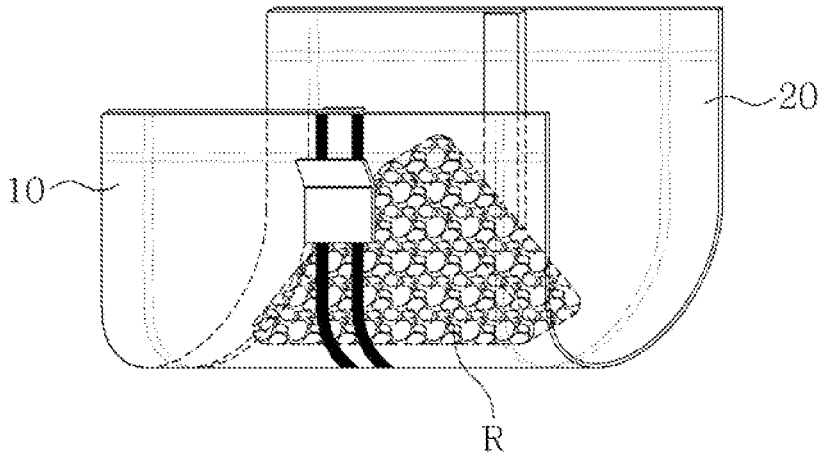
FIG. 5 is a view illustrating a step (a) of a procedure for wrapping rice using the wrapper for rice covered with laver in accordance with the present invention.

FIG. 5 is a view illustrating a step (a) of a procedure for wrapping rice using the wrapper for rice covered with laver in accordance with the present invention.

After a lump of rice R having a triangular shape is placed on the inner layer 20 of the wrapper for rice covered with layer, a part of the wrapper is folded upward at the bottom side of the triangular lump of rice so that the upper and lower portions of the wrapper are symmetrical with each other. Therefore, the front and rear surfaces of the rice are wrapped with the wrapper.

Figure 6:
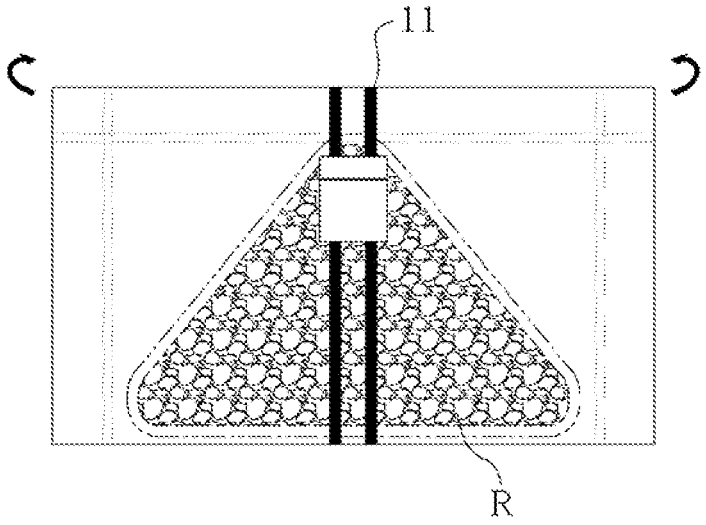
FIG. 6 is a view illustrating a step (b) of a procedure for wrapping rice using the wrapper for rice covered with laver in accordance with the present invention.

FIG. 6 is a view illustrating a step (b) of a procedure for wrapping rice using the wrapper for rice covered with laver in accordance with the present invention.

After that, the upper and side portions of the peripheral portions of the folded outer and inner layers 10 and 20 are attached to each other by thermal bonding means or the like. Then, the upper left and right corners of the folded wrapper for rice covered with laver are folded at the other sides of the triangular lump of rice toward the rear side of the triangular lump of rice.

Figure 7:
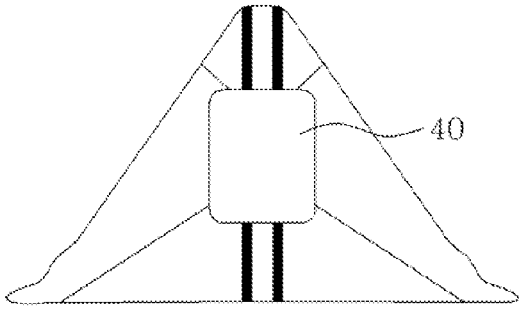
FIG. 7 is a view illustrating a step (c) of a procedure for wrapping rice using the wrapper for rice covered with laver in accordance with the present invention.

FIG. 7 is a view illustrating a step (c) of a procedure for wrapping rice using the wrapper for rice covered with laver in accordance with the present invention.

Finally, the folded right and left upper corners of the wrapper are attached to the outer layer 10 on the rear side of the lump of rice by adhesive means 40, such as an adhesive tape or a sticker, or adhesion. Therefore, the lump of rice covered with laver is completely wrapped.

Hereinafter, steps of a procedure for removing the wrapper from rice covered with layer, which is wrapped with the wrapper according to the present invention, will be described in more detail.

Figure 8:
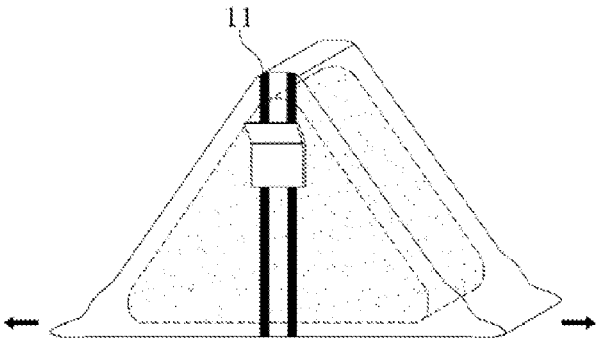
FIG. 8 is a view illustrating a step (a) of a process for cutting an outer layer of the wrapper for rice using the wrapper for rice covered with laver in accordance with the present invention.
Figure 8:
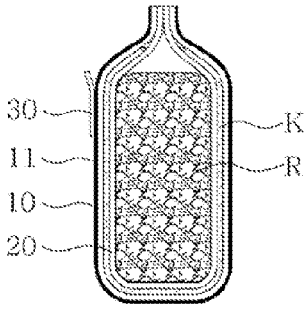

FIG. 8 is a view illustrating a step (a) of a process for cutting an outer layer of the wrapper for rice using the wrapper for rice covered with laver in accordance with the present invention.

First, a user grips the holding part 30A of the covering part 30 attached on upper surfaces of the outer layer 10.

Figure 9:
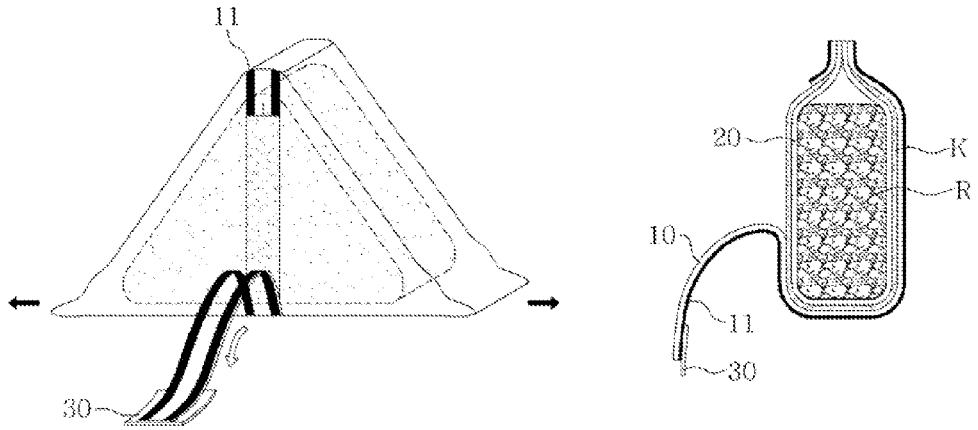
FIG. 9 is a view illustrating a step (b) of a process for cutting the outer layer of the wrapper for rice using the wrapper for rice covered with laver in accordance with the present invention.

FIG. 9 is a view illustrating a step (b) of a process for cutting the outer layer of the wrapper for rice using the wrapper for rice covered with laver in accordance with the present invention.

Then, the user pulls the gripped covering part 30 in a vertical direction from the top to the bottom on the front side of the triangular rice covered with layer. As a result, the portion of the outer layer 10 is cut so as to be separated into left and right halves with respect to a centerline.

At this time, since lower portions of the outer layer 10 are cut at a center of the first cutting groove 13, upper portions of the sealing part 10A are not broken.

Figure 10:
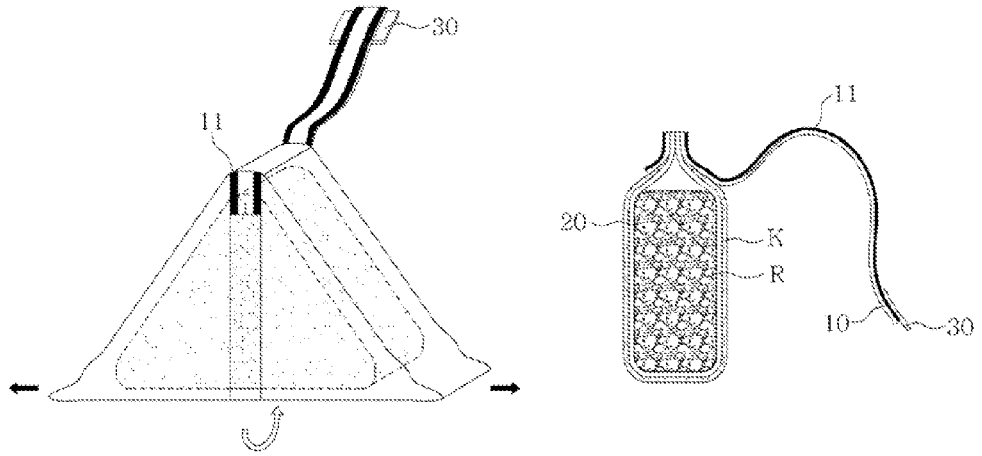
FIG. 10 is a view illustrating a step (c) of a process for cutting the outer layer of the wrapper for rice using the wrapper for rice covered with laver in accordance with the present invention.

FIG. 10 is a view illustrating a step (c) of a process for cutting the outer layer of the wrapper for rice using the wrapper for rice covered with laver in accordance with the present invention.

Finally, if the user continues to pull the covering part 30 from the bottom to the top through the bottom side of the triangular rice covered with layer, the rear side of the outer layer 10 is separated into left and right halves with respect to a centerline.

In this case, lower portions of the sealing part 20B are still remained without breaking.

Figure 11:
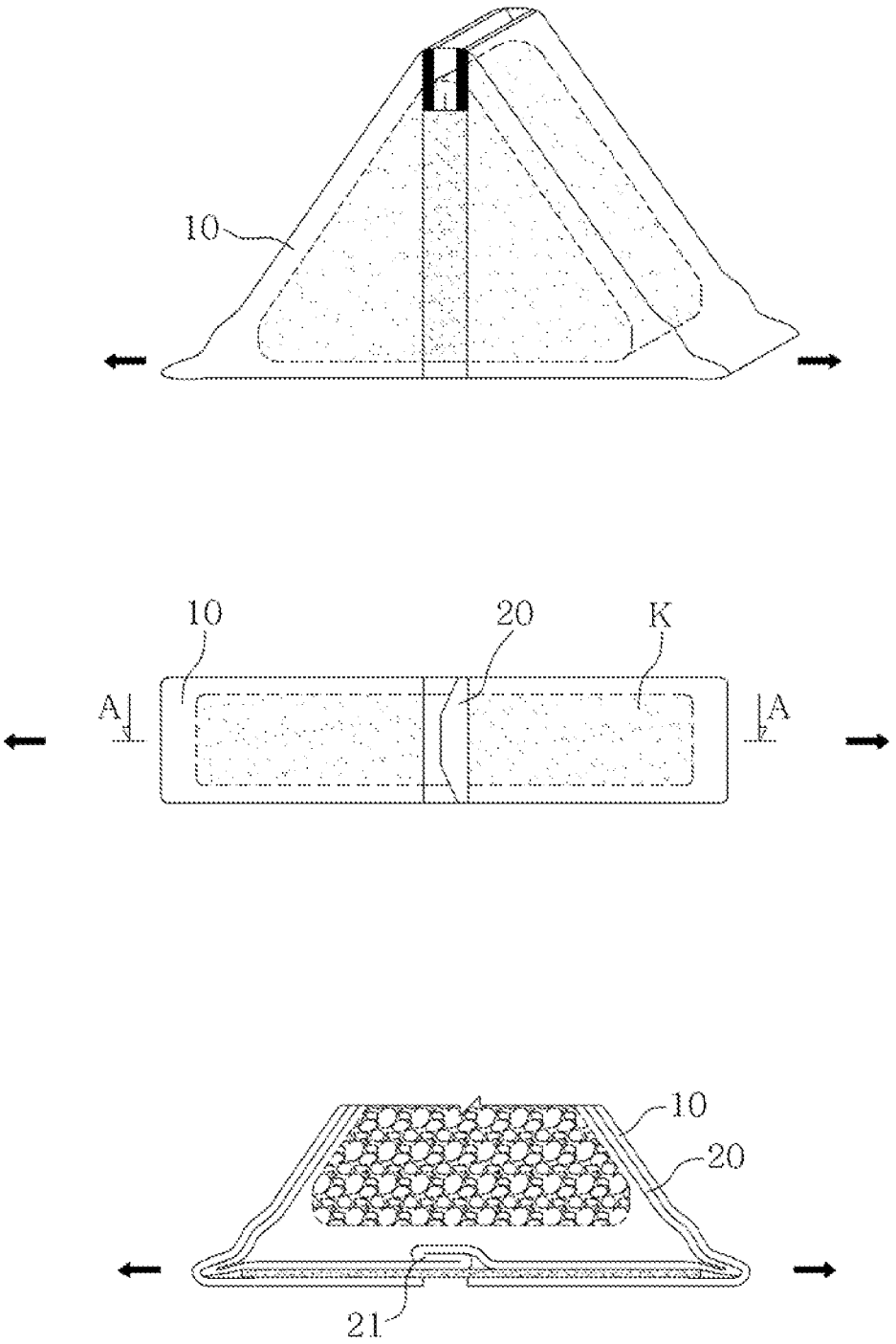
FIG. 11 is a view illustrating a step (a) of a process for cutting an inner layer of the wrapper for rice using the wrapper for rice covered with laver in accordance with the present invention.

FIG. 11 is a view illustrating a step (a) of a process for cutting an inner layer of the wrapper for rice using the wrapper for rice covered with laver in accordance with the present invention.

First, in order to cut the inner layer 20, a user grips both side portions of the outer and inner layers 10 and 20 on the bottom of a triangular layer-and-rice body and pulls the both side portions of the layers toward the left and right sides.

Figure 12:
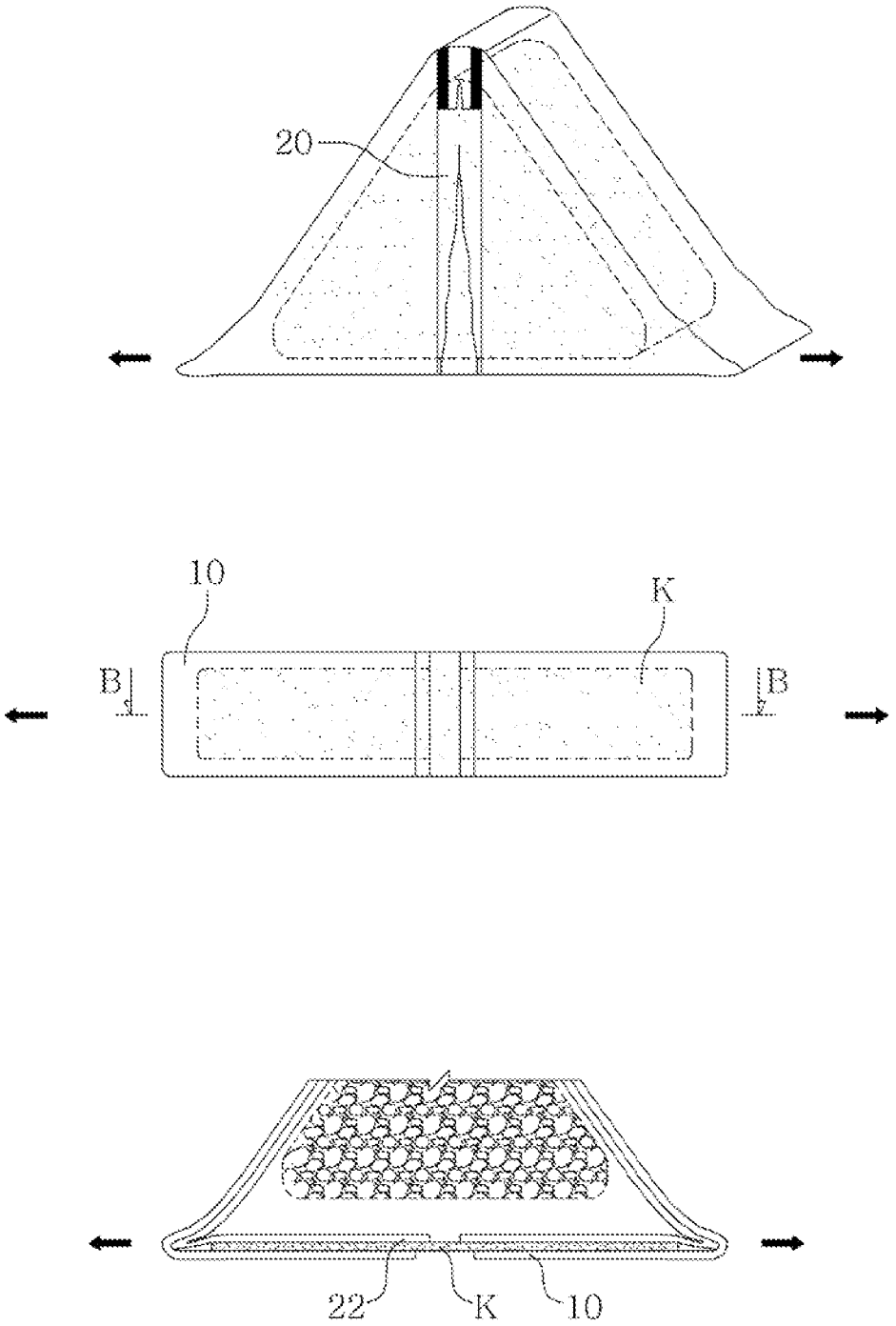
FIG. 12 is a view illustrating a step (b) of a process for cutting the inner layer of the wrapper for rice using the wrapper for rice covered with laver in accordance with the present invention.

FIG. 12 is a view illustrating a step (b) of a process for cutting the inner layer of the wrapper for rice using the wrapper for rice covered with laver in accordance with the present invention.

If the user continues to pull the left and right portions of the outer and inner layers 10 and 20, the folding part 21 formed in the inner layer 20 becomes unfolded and tension is concentrated on concaves 22 and 51. As a result, the concaves 22 and 51 are broken to be separated in advance, and the user can easily separate the inner layer 20.

Meanwhile, with increasingly breaking the inner layer 20, upper portions residual sealing part 20A at the outer layer 10 are broken by the second cutting groove 14. Lower portions of the sealing part 20B are broken by tension at both side portions, so that the outer layer 10 begins to be completely separated with respect to a vertical centerline.

Figure 13:
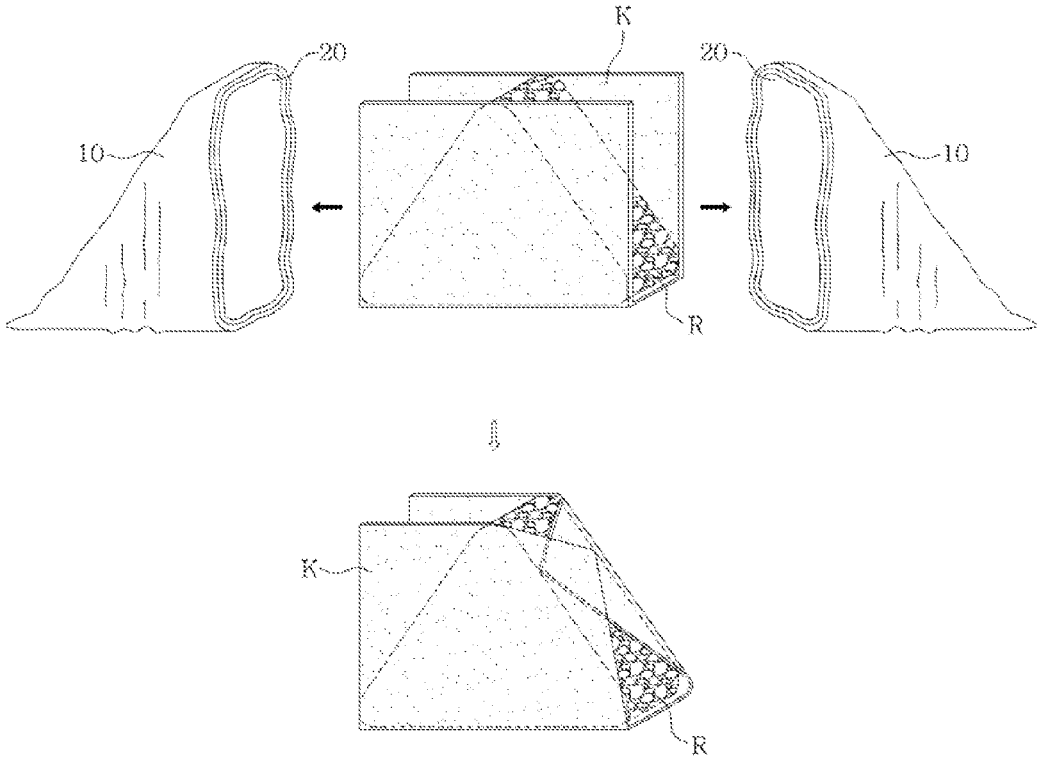
FIG. 13 is a showing that the outer and inner layers of the wrapper for rice using the wrapper for rice covered with laver in accordance with the present invention are cut form each other.
Figure 14:
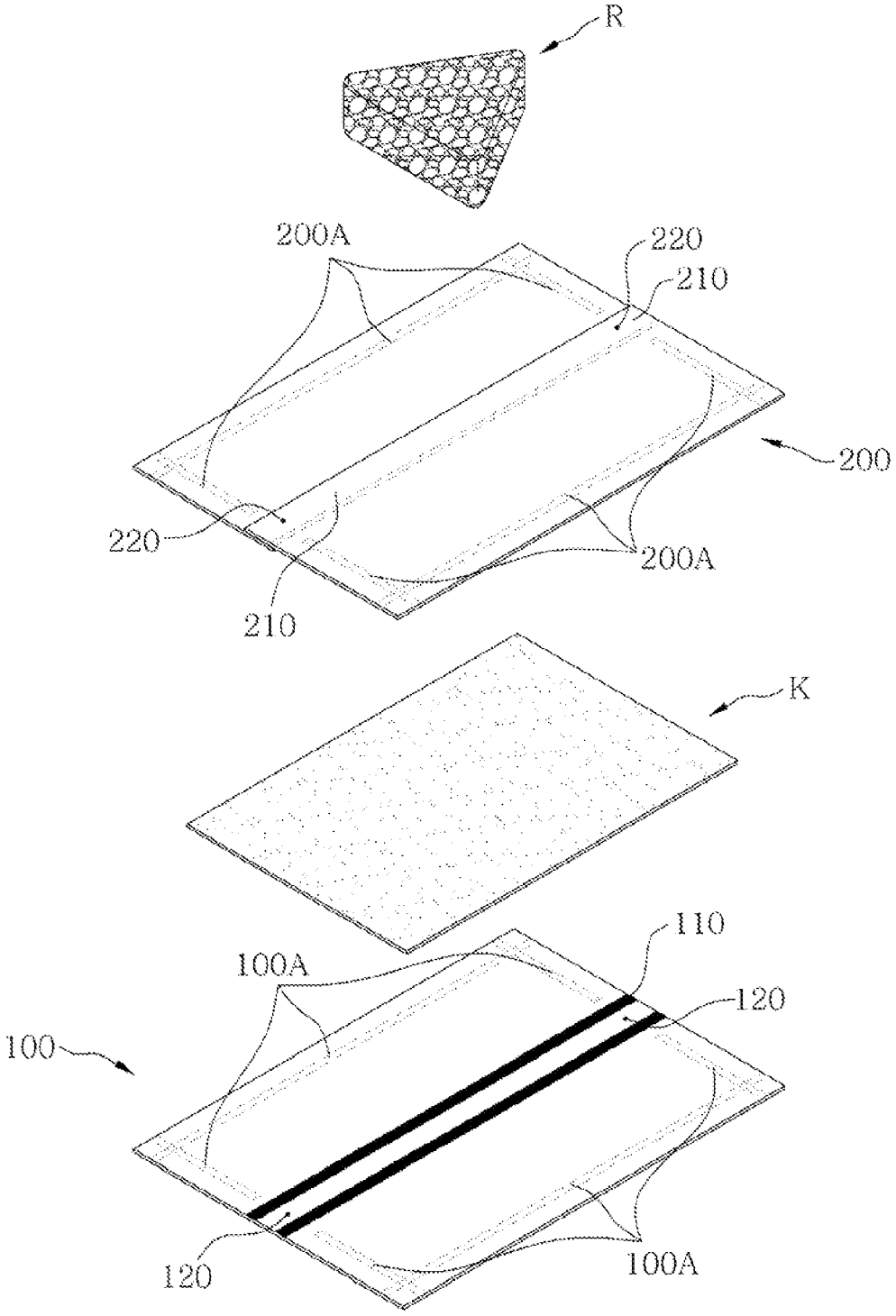
FIG. 14 is a view showing a conventional wrapper for rice covered with layer.

FIG. 13 is a showing that the outer and inner layers of the wrapper for rice using the wrapper for rice covered with laver in accordance with the present invention are cut form each other.

If a user continues to pull left and right sides of the outer and inner layers 10 and 20 of the wrapper for rice covered with layer, the outer and inner layers 10 and 20 are completely separated toward the left and right sides with respect to the vertical centerline, so that only laver K and rice R remain. Then the user wraps the triangular lump of rice R with laver K and eats the rice covered with layer.

In the present invention, an opening is not formed by sealing ends of the outer and inner layers 10 and 20, thereby basically preventing external air from being coming in.

In addition, the opening is not basically formed at the inner layer 20, and accordingly, the wrapper for rice covered with laver is completely sealed as a whole.

Therefore, since external air is not come in the wrapper for rice covered with layer, it is possible to allow expiration date to be lengthened, the taste of the rice covered with laver does not deteriorate, and laver is not made damp.

A method for cutting is the same as a conventional way, so that a user can easily and conveniently cut the wrapper for the rice covered with layer.

Furthermore, the user can cut the wrapper for the rice covered with laver only by applying weak power.

As described above, the present invention provides an air signboard having coupling bar as a coupling medium of a support and an air pillar to easily couple an air pillar.

While this invention has been particularly shown and described with reference to an exemplary embodiment thereof, it will be understood by those skilled in the art that various changes in form and details may be made therein without departing from the spirit and scope of the invention as defined by the appended claims.

What is claimed is:

1. A wrapper for covering food with layer, the wrapper comprising:

a first layer and a second layer formed of films and including inner layer sealing parts formed at outer peripheral portions of the films of each of the first and second layer, the films being sealed along the outer peripheral portions;

a folding part formed at the first layer and extending in a longitudinal direction, the folding part having a width in a lateral direction and the width of the folding part being uniformly formed in the lateral direction, wherein a concave is formed at a center of the folding part in the longitudinal direction, and the concave has a space where the width of the folding part is reduced in the longitudinal direction, wherein if tension is concentrated on the concave, the folding part formed in the inner layer is unfolded and the concave is broken to be separated;

a cutting groove comprising a lateral groove formed toward a lateral direction of the second film for cutting the second film according to a longitudinal direction; and a covering part attached to seal the cutting groove, and the cutting groove being formed under the sealing part in the longitudinal direction.

2. The wrapper of claim 1, wherein the lateral groove is formed in the horizontal direction or slantingly formed with respect to the lateral direction.

3. The wrapper of claim 1, wherein a longitudinal groove downwardly extending to a longitudinal direction is formed at an end of the lateral groove of the cutting groove, and wherein the covering part is attached to seal the longitudinal groove.

4. The wrapper of claim 1, wherein a second cutting groove being upwardly extending to a longitudinal direction is formed at the lateral groove of the cutting groove, and wherein the covering part is attached to seal the second cutting groove.

5. The wrapper of claim 1, wherein a cutting band extending to the longitudinal direction is formed at peripheral portions of the cutting groove.

* * * * *